US009657951B2

(12) United States Patent
Hrydovyy

(10) Patent No.: US 9,657,951 B2
(45) Date of Patent: May 23, 2017

(54) ETHANOL FIREPLACE INSERT

(71) Applicant: Vasyl Hrydovyy, Brooklyn, NY (US)

(72) Inventor: Vasyl Hrydovyy, Brooklyn, NY (US)

(73) Assignee: IGNIS DEVELOPMENT INC, Brooklyn, NY (US)

( * ) Notice: Subject to any disclaimer, the term of this patent is extended or adjusted under 35 U.S.C. 154(b) by 338 days.

(21) Appl. No.: 14/559,574

(22) Filed: Dec. 3, 2014

(65) Prior Publication Data

US 2016/0161126 A1 Jun. 9, 2016

(51) Int. Cl.

| | |
|---|---|
| ***F24C 5/00*** | (2006.01) |
| ***F24C 5/02*** | (2006.01) |
| ***F23D 5/04*** | (2006.01) |

(52) U.S. Cl.

CPC . *F24C 5/02* (2013.01); *F23D 5/04* (2013.01)

(58) Field of Classification Search

CPC .... F24C 5/00; F24C 1/16; F24C 15/10; F24C 15/14; F24C 5/02; F24B 1/191; F24B 1/182; F24B 1/192; F24B 1/193; F24B 3/00; A23L 1/01; A47J 33/00; A47J 37/04; A47J 37/06; A47J 37/08; F23C 3/00; F23D 3/18; F23D 14/02; F23D 5/04; F24F 13/20; F26B 11/02; F26B 19/00

See application file for complete search history.

(56) References Cited

U.S. PATENT DOCUMENTS

| | | | | |
|---|---|---|---|---|
| D631,953 S * | 2/2011 | Backes | ..... | D23/343 |
| 8,434,470 B2 * | 5/2013 | Jensen | ..... | F24C 5/00 126/512 |

* cited by examiner

*Primary Examiner* — Alfred Basichas

(57) ABSTRACT

An ethanol fireplace insert is a device for burning ethanol fuel in order to heat a space without transferring heat to a nearby object or wall. The ethanol fireplace insert features a base platform and an arch forming an insert that may be inserted into an existing fireplace or utilized as a standalone heating source. The ethanol fireplace insert is zero-clearance and features a plurality of insulation panels and a plurality of covers that prevent heat transfer from the ethanol fireplace insert to a nearby object or wall. The plurality of covers does not come into contact with the base platform and the arch due to a plurality of spacers that separates the base platform and the arch from the plurality of insulation panels and the plurality of covers. The burner is safely seated into a burner tray and the burner tray is seated into a safety tray.

18 Claims, 9 Drawing Sheets

ETHANOL FIREPLACE INSERT

FIELD OF THE INVENTION

The present invention relates generally to a fireplace insert. More specifically, the present invention is an ethanol fireplace insert for heating a space. The burning of ethanol in order to generate heat provides benefits such as a lack of harmful byproducts, little to no scent, and high heating efficiency.

BACKGROUND OF THE INVENTION

A fireplace is one of the most common forms of interior heating. Fireplaces are very simple to operate with a combustible fuel source (most commonly wood) placed into a firebox or firepit. The firebox or firepit serves to contain the fire. Smoke and other exhaust generated during combustion of the fuel source is able to escape via a chimney or other flue. While fireplaces provide warmth and contribute to a room's ambience and décor, they are not without their disadvantages and potential hazards. Long-term inhalation of wood smoke has been found to contribute to a host of health-related issues including chronic bronchitis and lung disease. This is due to the harmful emissions of wood combustion such as carbon monoxide and sulfur oxides. In addition to potential health-related consequences, the combustion of wood in a fireplace is generally an inefficient means of heating a space. Much of the heat provided by a fireplace is lost through a chimney or other flue.

The present invention is an ethanol fireplace insert for use in heating a space. The present invention is zero-clearance and as such, there is no risk of heat transfer to a nearby object or wall. The present invention is designed for use in conjunction with an existing fireplace. The present invention offers a number of advantages over a conventional fireplace. Ethanol is able to burn cleanly and produces no harmful byproducts aside from carbon dioxide and negligible amounts of carbon monoxide. As such, the present invention does not require a chimney or other flue. Furthermore, there is no need for a gas line or electric line as with some types of fireplaces. The present invention offers a high level of heating efficiency as no heat escapes through a chimney or other flue and all generated heat is able to enter the space being heated. Additional benefits of the present invention include the fact that there is generally little to no scent generated by the burning of ethanol. Finally, the present invention offers the same visual/aesthetic benefits of a regular fire as real flames are generated by the burning of ethanol.

DETAIL DESCRIPTIONS OF THE INVENTION

All illustrations of the drawings are for the purpose of describing selected versions of the present invention and are not intended to limit the scope of the present invention.

Figure 2:
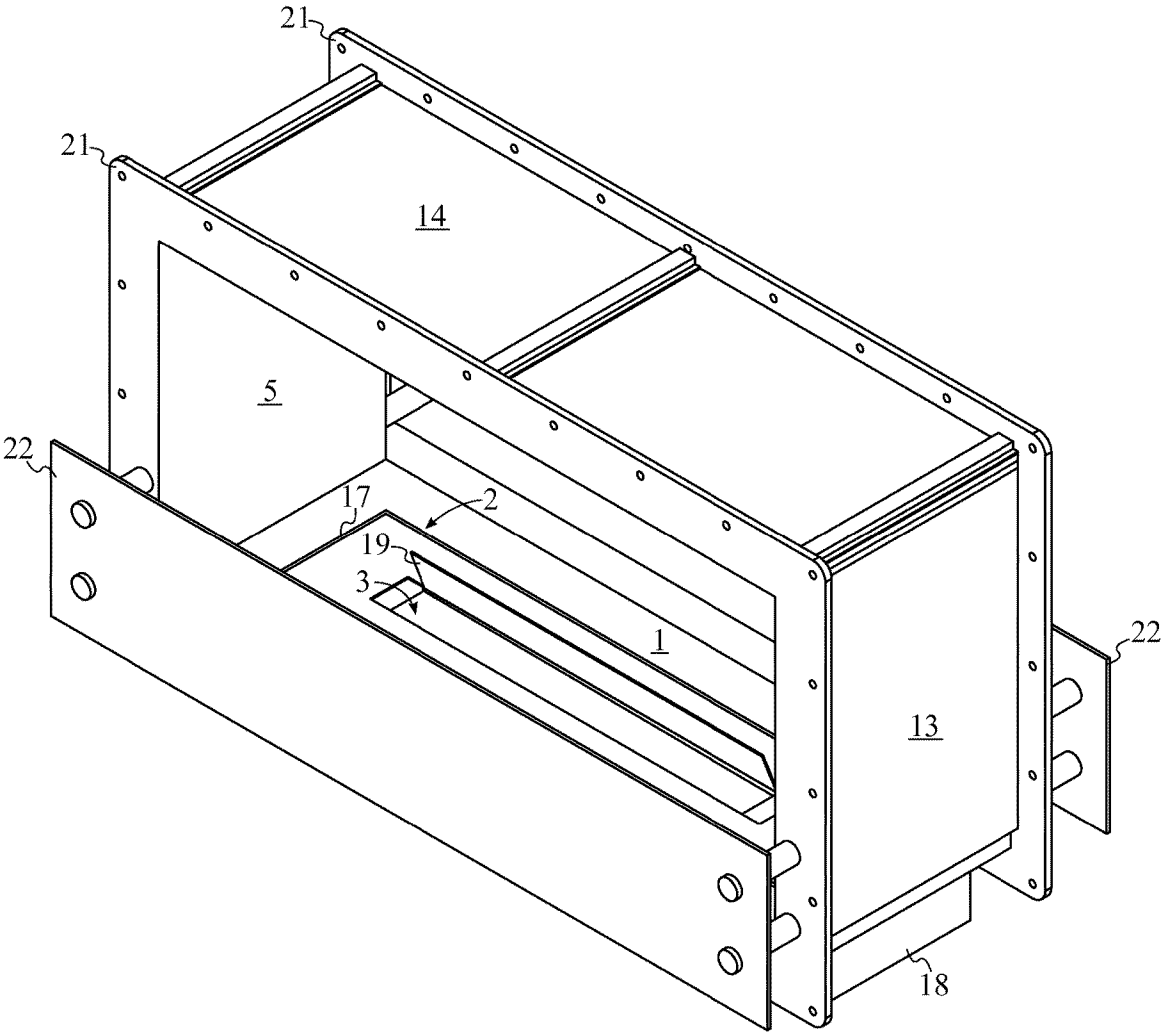
FIG. 2 is a perspective view of the present invention.
Figure 3:
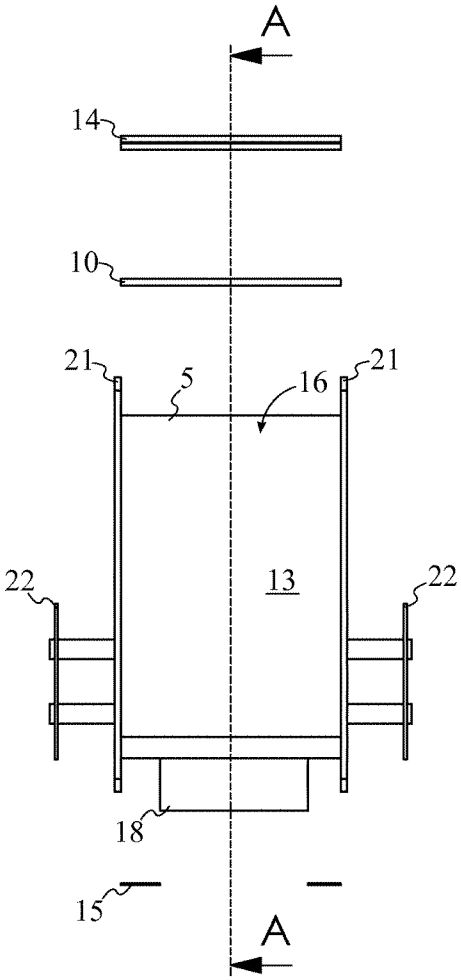
FIG. 3 is an exploded side view of the present invention.
Figure 4:
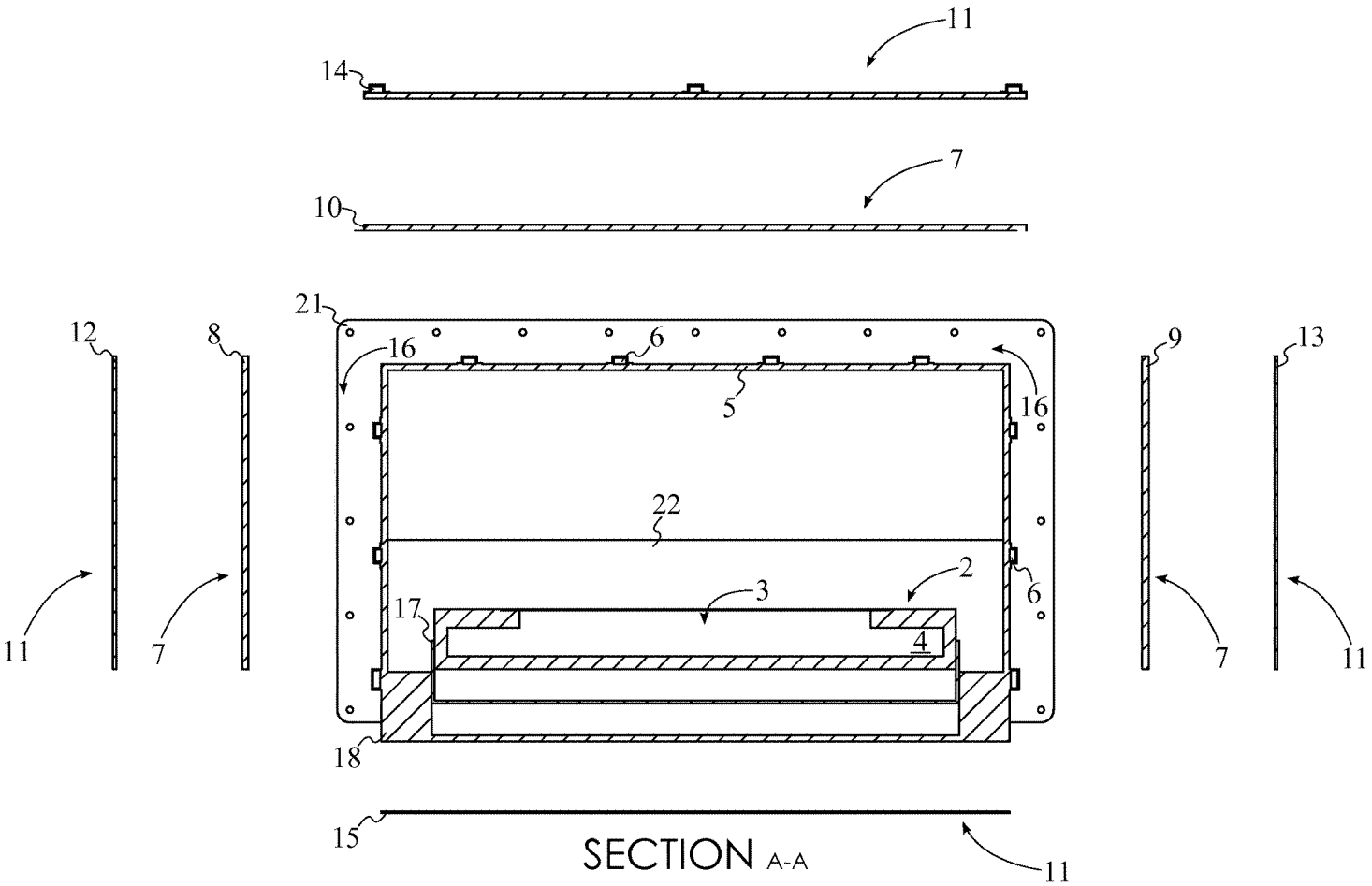
FIG. 4 is an exploded cross-sectional view of the present invention taken along line A-A of FIG. 3.
Figure 5:
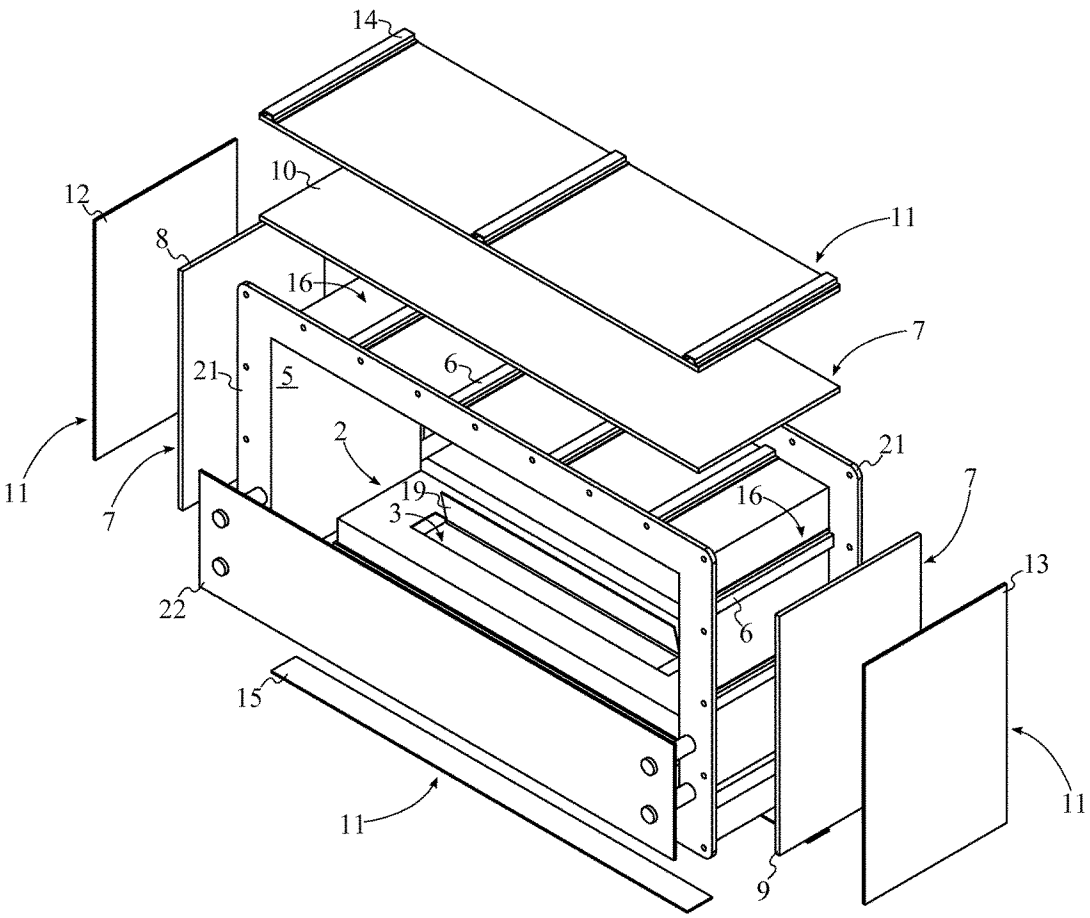
FIG. 5 is an exploded perspective view of the present invention.
Figure 6:
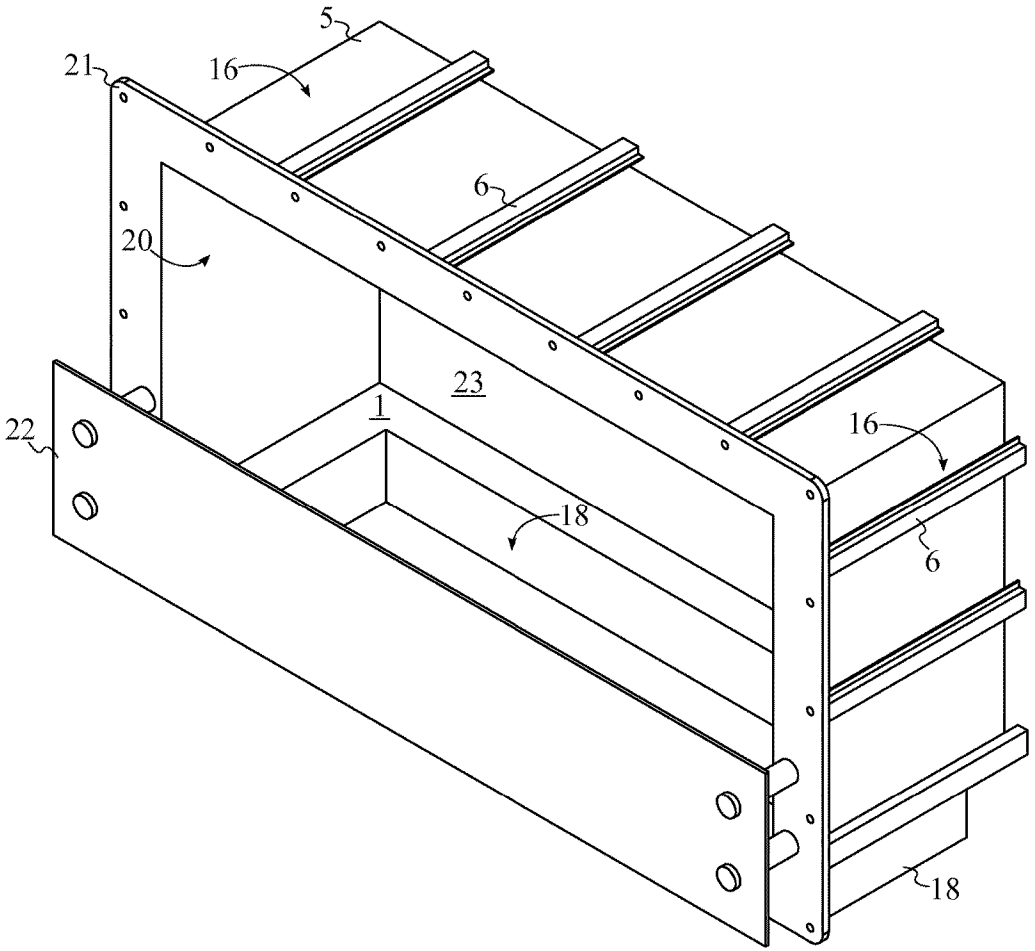
FIG. 6 is a perspective view of an alternative embodiment of the present invention without the plurality of insulation panels, the plurality of covers, and the burner.
Figure 7:
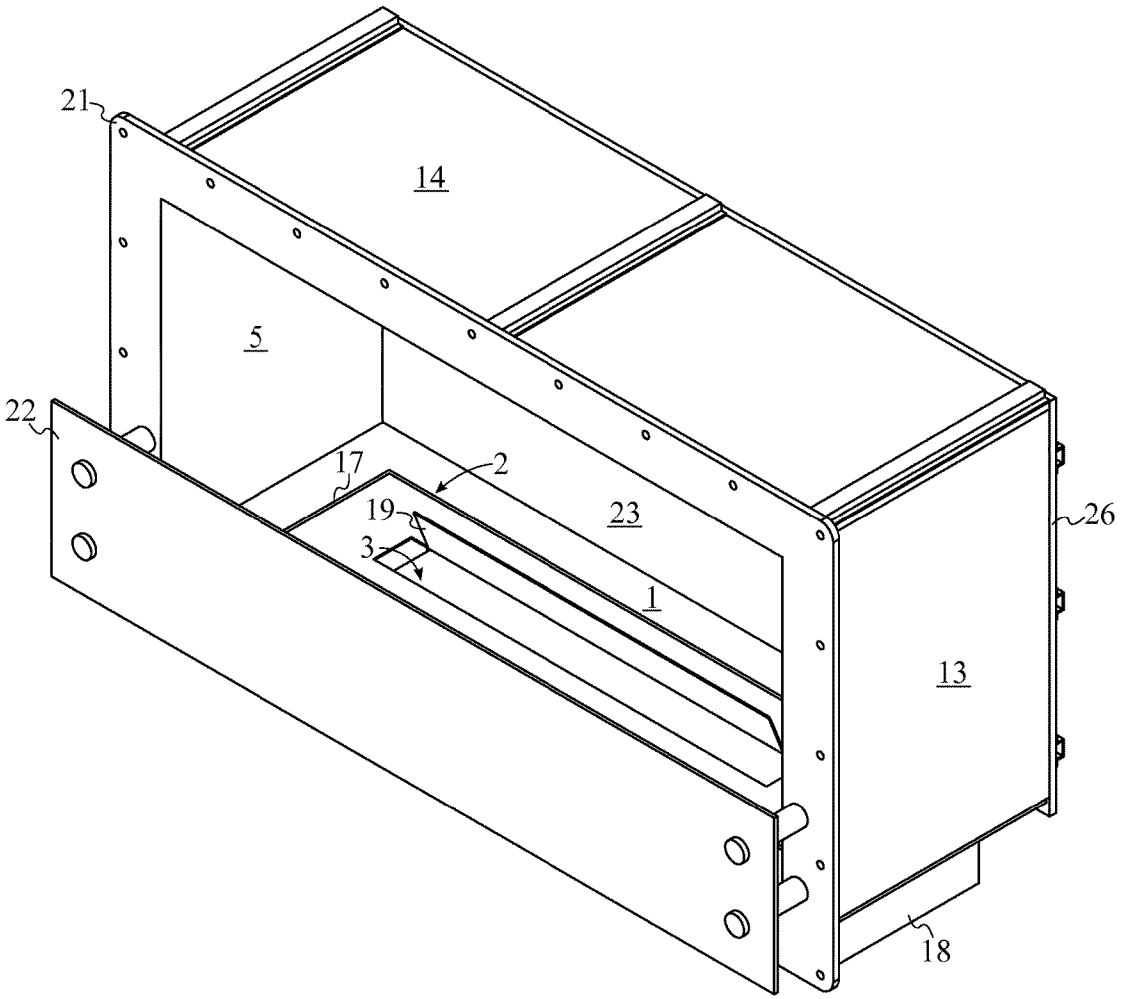
FIG. 7 is a perspective view of the alternative embodiment of the present invention.
Figure 8:
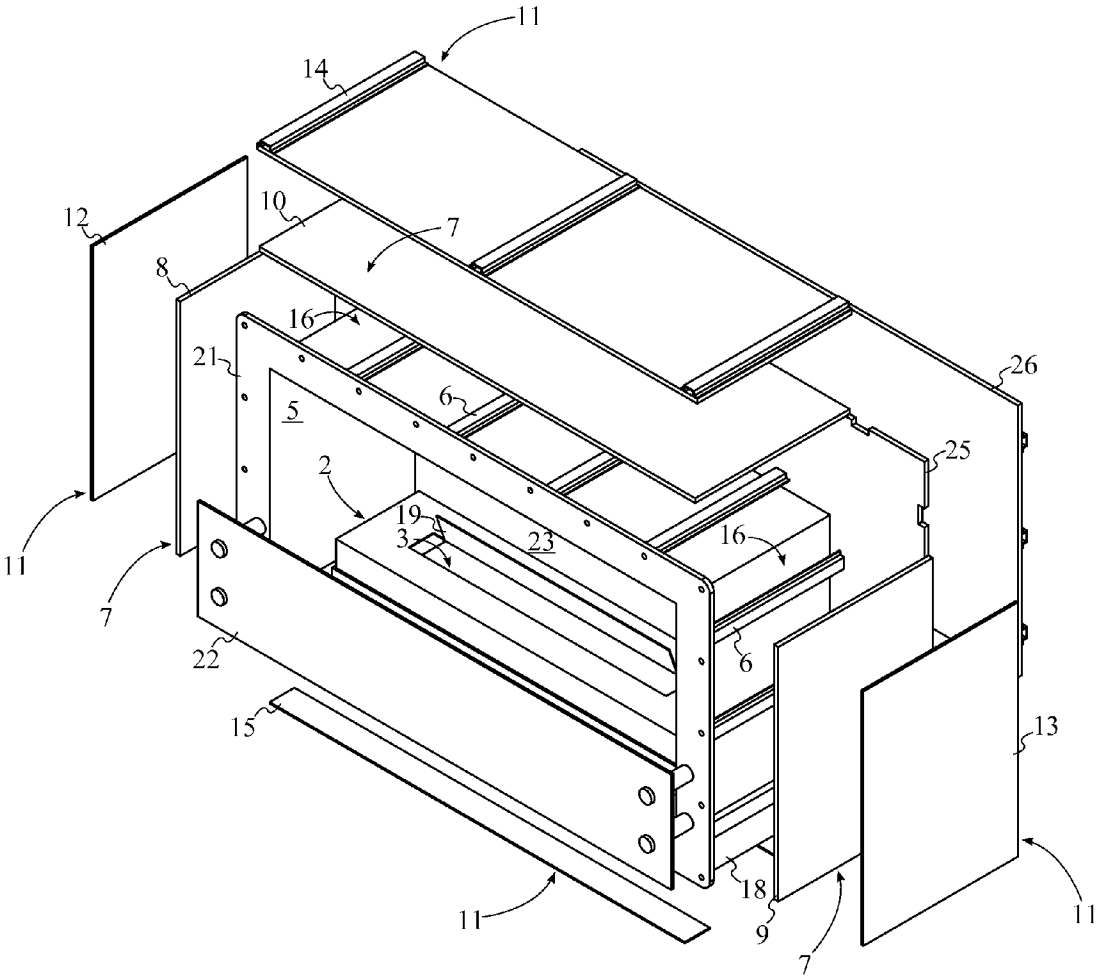
FIG. 8 is an exploded perspective view of the alternative embodiment of the present invention.

The present invention is an ethanol fireplace insert for use in heating a space. The present invention allows for the clean burning of ethanol, resulting in no harmful byproducts being produced and eliminating the need for a chimney or other flue. The preferred embodiment of the present invention is shown in FIGS. 1-5 and comprises a base platform 1, a burner 2, an arch 5, a plurality of spacers 6, a plurality of insulation panels 7, and a plurality of covers 11. In the preferred embodiment of the present invention, the base platform 1 and the arch 5 form a rectangular ethanol fireplace insert that may be inserted into an existing fireplace. The burner 2 is utilized to burn ethanol and produce heat. As shown in FIGS. 3-5, the plurality of spacers 6 separates the plurality of insulation panels 7 from the arch 5. Additionally, the plurality of spacers 6 separates the plurality of covers 11 from the base platform 1 and the arch 5. The plurality of covers 11 ensures that the plurality of insulation panels 7 is not exposed to the exterior environment. The present invention is zero-clearance in that the positioning of the plurality of insulation panels 7 in between the arch 5 and the plurality of covers 11 ensures that no heat is able to transfer from the present invention to a nearby object or wall.

Figure 1:
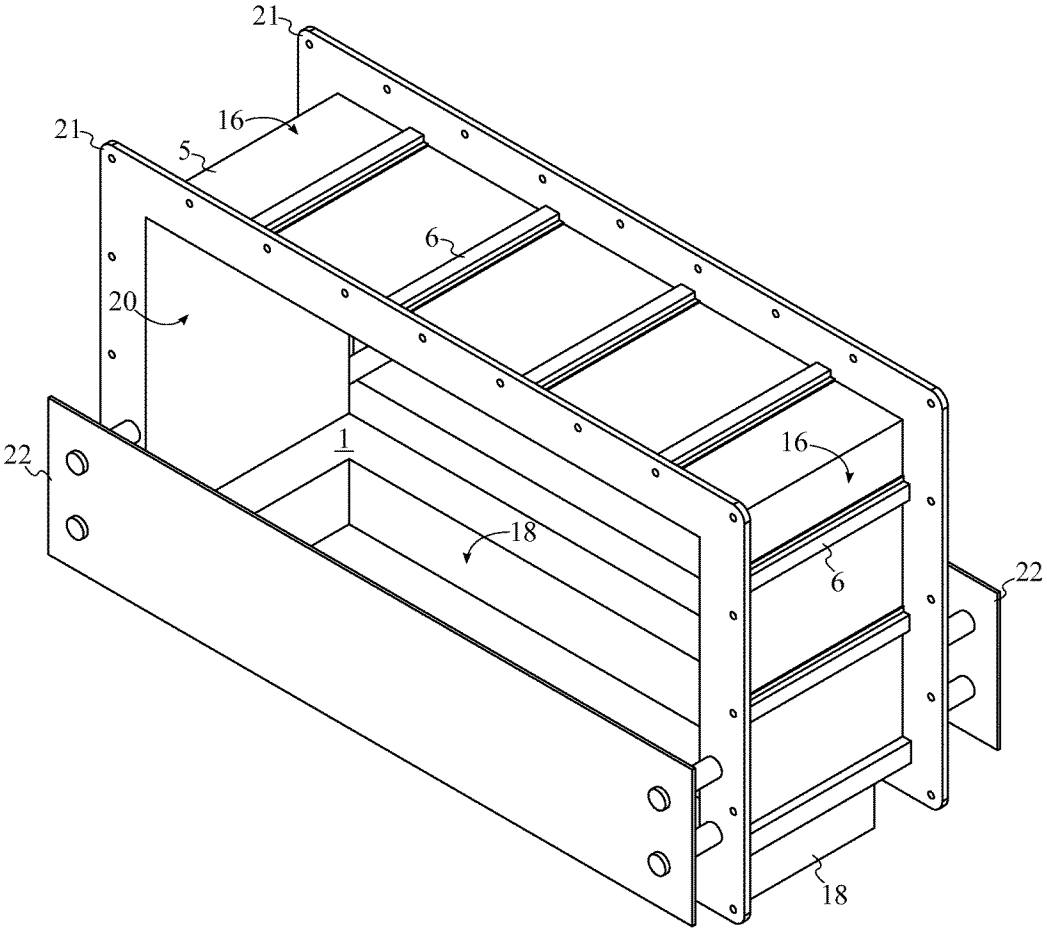
FIG. 1 is a perspective view of the present invention without the plurality of insulation panels, the plurality of covers, and the burner.

As shown in FIG. 1, the arch 5 is adjacently connected across the base platform 1, forming a frame structure that may be inserted into an existing fireplace. The burner 2 is mounted onto the base platform 1 in between the arch 5. The positioning of the burner 2 in between the arch 5 ensures that flames produced during the burning of alcohol are contained in between the arch 5. The plurality of spacers 6 is evenly distributed about the base platform 1 and the arch 5, allowing the plurality of covers 11 to sufficiently cover all exposed external surfaces of the present invention as shown in FIG. 2. As such, the plurality of covers 11 is evenly distributed about the arch 5 and the base platform 1. Additionally, the plurality of insulation panels 7 is evenly distributed about the arch 5, allowing the plurality of insulation panels 7 to provide sufficient insulation to the arch 5 and prevent heat transfer from the present invention to an external object or wall.

Again with reference to FIG. 1, the present invention further comprises a receiving channel 16. The receiving channel 16 serves as the mounting surface for the plurality of spacers 6 and is integrated about the base platform 1 and the arch 5. Each of the plurality of spacers 6 is mounted across the receiving channel 16 in order to allow the plurality of insulation panels 7 and the plurality of covers 11 to be mounted to the plurality of spacers 6. The plurality of insulation panels 7 is pressed against the plurality of spacers 6 in order to prevent heat transfer from the present invention to a nearby object or wall. Additionally, the plurality of insulation panels 7 is pressed against the plurality of spacers 6 in order to secure the plurality of insulation panels 7 in place in between the plurality of spacers 6 and the plurality of covers 11. The plurality of spacers 6 additionally creates pockets of air in between the arch 5 and the plurality of insulation panels 7. This increases the insulative properties of the present invention as air features a relatively low thermal conductivity. The plurality of covers 11 is connected to the base platform 1 and the arch 5 across the receiving channel 16 in order to ensure that all exposed external surfaces of the present invention are covered by the plurality of insulation panels 7 and/or the plurality of covers 11.

In the preferred embodiment of the present invention, the arch 5 has a rectangular shape as shown in FIG. 4 and FIG. 5 so that the present invention can be mounted fireplaces with a similar rectangular shape. For this embodiment, the plurality of insulation panels 7 comprises a left side insulation panel 8, a right side insulation panel 9, and a top insulation panel 10, which are able to provide thermal insulation to the corresponding left side, right side, and top side of the arch 5. Also for this embodiment, the plurality of covers 11 comprises a left side cover 12, a right side cover 13, a top cover 14, and an at least one bottom cover 15, which respectively cover the left side insulation panel 8, the right side insulation panel 9, and the top insulation panel 10, and the base platform 1. The left side insulation panel 8 is positioned in between the plurality of spacers 6 and the left side cover 12. The right side insulation panel 9 is positioned in between the plurality of spacers 6 and the right side cover 13. Finally, the top insulation panel 10 is positioned in between the plurality of spacers 6 and the top cover 14. The positioning of the left side insulation panel 8, the right side insulation panel 9, and the top insulation panel 10 in between the plurality of spacers 6 and the left side cover 12, the right side cover 13, and the top cover 14 ensures that heat is not able to transfer from the present invention through the arch 5. The left side insulation panel 8, the right side insulation panel 9, and the top insulation panel 10 provide thermal insulation to the corresponding left side, right side, and top side of the arch 5. Moreover, the at least one bottom cover 15 is positioned onto the plurality of spacers 6 to provide separation between the base platform 1 and the at least one bottom cover 15. The bottom of the arch 5 does not include an insulation panel as the majority of heat generated from burning fuel is directed toward the left side insulation panel 8, the right side insulation panel 9, and the top insulation panel 10.

Also for the preferred embodiment of the present invention, the left side insulation panel 8 is laterally and perpendicularly connected to the top insulation panel 10 while the right side insulation panel 9 is laterally and perpendicularly connected to the top insulation panel 10, opposite to the left side insulation panel 8. As such, the left side insulation panel 8, the right side insulation panel 9, and the top insulation panel 10 are able to provide a continuous layer of insulation to all exposed surfaces of the arch 5. Similarly, the left side cover 12 is laterally and perpendicularly connected to the top cover 14 while the right side cover 13 is laterally and perpendicularly connected to the top cover 14, opposite to the left side cover 12. As such, the left side cover 12, the right side cover 13, and the top cover 14 are able to provide a housing such that the left side insulation panel 8, the right side insulation panel 9, and the top insulation panel 10 are not exposed to the exterior environment. In other embodiments of the present invention, the arch 5 can be a semicircular shape or any other shape that spans across the base platform 1. In these other embodiments, the size, the shape, and the number of both the plurality of insulation panels 8 and the plurality of covers 12 can vary to accommodate the design of a fireplace.

Again with reference to FIG. 2 and FIG. 4, the present invention further comprises a burner tray 17. The burner tray 17 serves as a seat for the burner 2 when the burner 2 is mounted into the base platform 1 in between the arch 5. The burner 2 comprises a vent 3 and a fuel reservoir 4. The fuel reservoir 4 serves to hold a quantity of fuel for the burner 2 while the vent 3 provides an opening through which the fuel reservoir 4 may be filled as well as an opening through which flames from a burning fuel may be visible. In the preferred embodiment of the present invention, the fuel reservoir 4 stores a quantity of ethanol. The burner tray 17 is mounted into the base platform 1 in order to contain the burner tray 17 within the base platform 1. The fuel reservoir 4 is similarly mounted into the burner tray 17 in order to contain both the fuel reservoir 4 and the burner tray 17 within the base platform 1. Safely containing the fuel reservoir 4 and the burner tray 17 within the base platform 1 reduces the likelihood of fuel spillage during filling of the fuel reservoir 4. The vent 3 is positioned opposite to the burner tray 17 through the burner 2. This positioning of the vent 3 allows flames from burning fuel within the fuel reservoir 4 to escape upward through the vent 3 when heating a space.

The present invention further comprises a safety tray 18. Functioning similar to the burner tray 17, the safety tray 18 serves as a seat for the burner tray 17 and the burner 2. The safety tray 18 is integrated into the base platform 1 in order to contain the burner tray 17 and the burner 2 within the base platform 1. The burner tray 17 is mounted into the safety tray 18 in order to secure the burner tray 17 and the burner 2 in place within the safety tray 18.

The present invention further comprises an extinguishing door 19. The extinguishing door 19 is utilized in order to extinguish flames produced by burning fuel in the fuel reservoir 4 when the user wishes to cease using the present invention to heat a space. The extinguishing door 19 is hingedly connected to the burner 2, adjacent to the vent 3, allowing the extinguishing door 19 to cover flames escaping from the fuel reservoir 4 through the vent 3. The extinguishing door 19 is selectively and hermetically positioned over the vent 3. When the extinguishing door 19 is hermetically positioned over the vent 3, oxygen supply to any flames generated in the fuel reservoir 4 is cut off, extinguishing the flames. In the preferred embodiment of the present invention, the extinguishing door 19 may be manually actuated by a tool.

The present invention further comprises an opening 20 and an at least one lip 21. The opening 20 is delineated by the arch 5 and the base platform 1 and provides space for the flames produced by burning fuel within the fuel reservoir 4. The at least one lip 21 provides a surface to which the plurality of covers 11 may be connected. The at least one lip 21 is laterally connected around the base platform 1 and the arch 5, adjacent to the opening 20. This allows the left side cover 12, the right side cover 13, the top cover 14, and the at least one bottom cover 15 to be connected to the at least one lip 21. The left side cover 12, the right side cover 13, the top cover 14, and the at least one bottom cover 15 are laterally connected to the at least one lip 21 and are thus secured in place on the present invention. In the preferred embodiment of the present invention, the left side cover 12, the right side cover 13, the top cover 14, and the at least one bottom cover 15 are welded to the at least one lip 21.

The present invention further comprises an at least one fireplace shield 22. The at least one fireplace shield 22 serves as a protective barrier against excessive heat generated by the burning of fuel within the fuel reservoir 4. In the preferred embodiment of the present invention, the at least one fireplace shield 22 is a glass fire screen. The at least one fireplace shield 22 is connected to the at least one lip 21 across the opening 20, allowing the at least one fireplace shield 22 to serve as a protective barrier across the opening 20. In the preferred embodiment of the present invention shown in FIGS. 1-5, the at least one fireplace shield 22 includes a front fireplace shield and a rear fireplace shield. The front fireplace shield and the rear fireplace shield are able to provide protection against excessive heat to both the front and the rear of the present invention.

Figure 9:
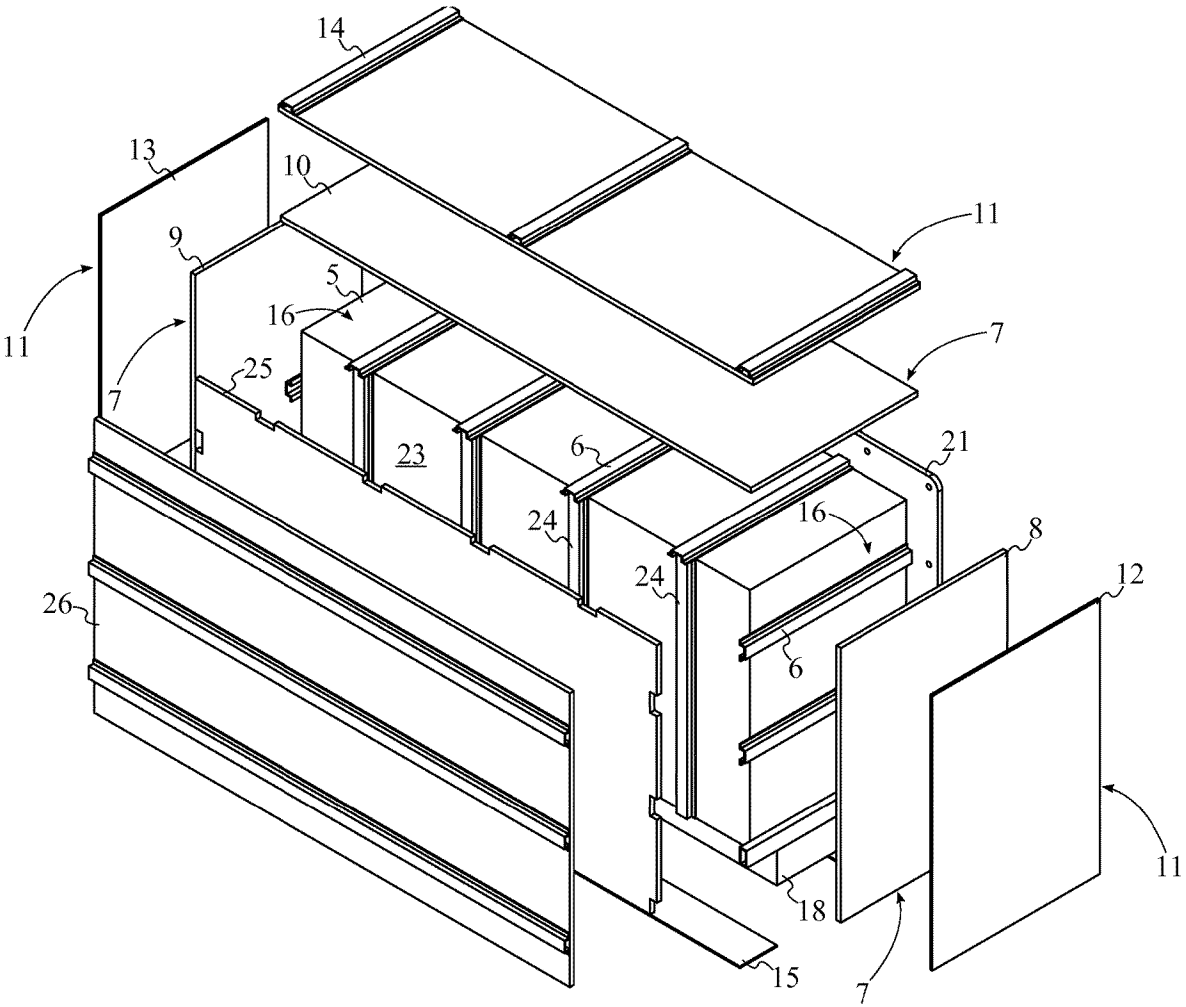
FIG. 9 is an alternate exploded perspective view of the alternative embodiment of the present invention.

In the alternative embodiment of the present invention shown in FIGS. 6-9, the present invention further comprises a rear wall 23, a plurality of rear spacers 24, a rear insulation panel 25, and a rear cover 26. The rear wall 23 closes off the rear portion of the rectangular ethanol fireplace insert formed by the base platform 1 and the arch 5. The plurality of rear spacers 24, as shown in FIG. 9, functions in the same manner as the plurality of spacers 6 and separates the rear insulation panel 25 from the rear wall 23. Similar to the plurality of spacers 6, the plurality of rear spacers 24 creates air pockets in between the rear wall 23 and the rear insulation panel 25, increasing the insulation properties of the present invention. The rear insulation panel 25 prevents heat transfer from the present invention through the rear wall 23 and the rear cover 26. The rear cover 26 prevents exposure of the rear insulation panel 25 to the exterior environment. The rear wall 23 is perpendicularly connected to the base platform 1 and the arch 5 in order to close off the rear portion of the base platform 1 and the arch 5. The plurality of rear spacers 24 is evenly distributed across the rear wall 23 in order to allow the rear cover 26 to sufficiently cover the entire surface of the rear wall 23. The rear insulation panel 25 is positioned in between the rear wall 23 and the rear cover 26. This ensures that no heat from the present invention is able to transfer to a nearby object or wall.

In the alternative embodiment of the present invention, the rear insulation panel 25 is perpendicularly connected to the top insulation panel 10, the left side insulation panel 8, and the right side insulation panel 9. The positioning of the rear insulation panel 25 allows the rear insulation panel 25 to provide sufficient insulation for the rear wall 23. Similarly, the rear cover 26 is perpendicularly connected to the top cover 14, the left side cover 12, and the right side cover 13. As such, the rear cover 26 is positioned over the rear insulation panel 25 in order to prevent the rear insulation panel 25 from being exposed to the exterior environment. In the preferred embodiment of the present invention, the rear cover 26 is welded to the top cover 14, the left side cover 12, and the right side cover 13.

In the preferred embodiment of the present invention, it is possible to see through the opening 20 delineated by the arch 5 and the base platform as the rear wall 23 is not present. As such, the preferred embodiment of the present invention is able to function as a standalone fireplace (for example, in the center of a room that the user wishes to heat). The rear wall 23 closes off the rear portion of the base platform and the arch 5. As such, the alternative embodiment of the present invention is suitable for insertion into an existing fireplace.

Although the present invention has been explained in relation to its preferred embodiment, it is understood that many other possible modifications and variations can be made without departing from the spirit and scope of the present invention as hereinafter claimed.

What is claimed is:

1. An ethanol fireplace insert comprises:
- a base platform;
- a burner;
- an arch;
- a plurality of spacers;
- a plurality of insulation panels;
- a plurality of covers;
- the arch being adjacently connected across the base platform;
- the burner being mounted onto the base platform in between the arch;
- the plurality of spacers being evenly distributed about the base platform and the arch;
- the plurality of insulation panels being evenly distributed about the arch;
- the plurality of covers being evenly distributed about the arch and the base platform;
- a rear wall;
- a plurality of rear spacers;
- a rear insulation panel;
- a rear cover;
- the rear wall being perpendicularly connected to the base platform and the arch;
- the plurality of rear spacers being evenly distributed across the rear wall; and
- the rear insulation panel being positioned in between the rear wall and the rear cover.

2. The ethanol fireplace insert as claimed in claim 1 comprises:
- a receiving channel;
- the receiving channel being integrated about the base platform and the arch;
- each of the plurality of spacers being mounted across the receiving channel;
- the plurality of insulation panels being pressed against the plurality of spacers; and
- the plurality of covers being connected to the base platform and the arch across the receiving channel.

3. The ethanol fireplace insert as claimed in claim 1 comprises:
- the plurality of insulation panels comprises a left side insulation panel, a right side insulation panel, and a top insulation panel;
- the plurality of covers comprises a left side cover, a right side cover, a top cover, and an at least one bottom cover;
- the left side insulation panel being positioned in between the plurality of spacers and the left side cover;
- the right side insulation panel being positioned in between the plurality of spacers and the right side cover;
- the top insulation panel being positioned in between the plurality of spacers and the top cover; and
- the at least one bottom cover being positioned onto the plurality of spacers.

4. The ethanol fireplace insert as claimed in claim 3 further comprises:
- the left side insulation panel being laterally and perpendicularly connected to the top insulation panel;
- the right side insulation panel being laterally and perpendicularly connected to the top insulation panel, opposite to the left side insulation panel;
- the left side cover being laterally and perpendicularly connected to the top cover; and
- the right side cover being laterally and perpendicularly connected to the top cover, opposite to the left side cover.

5. The ethanol fireplace insert as claimed in claim 1 further comprises:
- a burner tray;
- the burner comprises a vent and a fuel reservoir;
- the burner tray being mounted into the base platform;
- the fuel reservoir being mounted into the burner tray; and the vent being positioned opposite to the burner tray through the burner.

6. The ethanol fireplace insert as claimed in claim 5 further comprises:

a safety tray;

the safety tray being integrated into the base platform; and the burner tray being mounted into the safety tray.

7. The ethanol fireplace insert as claimed in claim 5 further comprises:

an extinguishing door;

the extinguishing door being hingedly connected to the burner, adjacent to the vent; and the extinguishing door being selectively and hermetically positioned over the vent.

8. The ethanol fireplace insert as claimed in claim 1 further comprises:

an opening;

at least one lip;

the opening being delineated by the arch and the base platform;

the at least one lip being laterally connected around the base platform and the arch, adjacent to the opening; and the left side cover, the right side cover, the top cover, and the at least one bottom cover being laterally connected to the at least one lip.

9. The ethanol fireplace insert as claimed in claim 1 further comprises:

an opening;

at least one fireplace shield;

the opening being delineated by the arch and the base platform; and the at least one fireplace shield being connected to an at least one lip across the opening.

10. The ethanol fireplace insert as claimed in claim 1 further comprises:

the plurality of insulation panels comprises a left side insulation panel, a right side insulation panel, and a top insulation panel;

the plurality of covers comprises a left side cover, a right side cover, a top cover, and an at least one bottom cover;

the rear insulation panel being perpendicularly connected to the top insulation panel, the left side insulation panel, and the right side insulation panel; and the rear cover being perpendicularly connected to the top cover, the left side cover, and the right side cover.

11. An ethanol fireplace insert comprises:

a base platform;

a burner;

an arch;

a plurality of spacers;

a plurality of insulation panels;

a plurality of covers;

a receiving channel;

the arch being adjacently connected across the base platform;

the burner being mounted onto the base platform in between the arch;

the plurality of spacers being evenly distributed about the base platform and the arch;

the plurality of insulation panels being evenly distributed about the arch;

the plurality of covers being evenly distributed about the arch and the base platform;

the receiving channel being integrated about the base platform and the arch;

each of the plurality of spacers being mounted across the receiving channel;

the plurality of insulation panels being pressed against the plurality of spacers;

the plurality of covers being connected to the base platform and the arch across the receiving channel;

a rear wall;

a plurality of rear spacers;

a rear insulation panel;

a rear cover;

the rear wall being perpendicularly connected to the base platform and the arch;

the plurality of rear spacers being evenly distributed across the rear wall; and the rear insulation panel being positioned in between the rear wall and the rear cover.

12. The ethanol fireplace insert as claimed in claim 11 further comprises:

the plurality of insulation panels comprises a left side insulation panel, a right side insulation panel, and a top insulation panel;

the plurality of covers comprises a left side cover, a right side cover, a top cover, and an at least one bottom cover;

the left side insulation panel being positioned in between the plurality of spacers and the left side cover;

the right side insulation panel being positioned in between the plurality of spacers and the right side cover;

the top insulation panel being positioned in between the plurality of spacers and the top cover;

the at least one bottom cover being positioned onto the plurality of spacers;

the left side insulation panel being laterally and perpendicularly connected to the top insulation panel;

the right side insulation panel being laterally and perpendicularly connected to the top insulation panel, opposite to the left side insulation panel;

the left side cover being laterally and perpendicularly connected to the top cover; and the right side cover being laterally and perpendicularly connected to the top cover, opposite to the left side cover.

13. The ethanol fireplace insert as claimed in claim 11 further comprises:

a burner tray;

the burner comprises a vent and a fuel reservoir;

the burner tray being mounted into the base platform;

the fuel reservoir being mounted into the burner tray; and the vent being positioned opposite to the burner tray through the burner.

14. The ethanol fireplace insert as claimed in claim 13 further comprises:

a safety tray;

the safety tray being integrated into the base platform; and the burner tray being mounted into the safety tray.

15. The ethanol fireplace insert as claimed in claim 13 further comprises:

an extinguishing door;

the extinguishing door being hingedly connected to the burner, adjacent to the vent; and the extinguishing door being selectively and hermetically positioned over the vent.

16. The ethanol fireplace insert as claimed in claim 11 further comprises:

an opening;

at least one lip;

the opening being delineated by the arch and the base platform;

the at least one lip being laterally connected around the base platform and the arch, adjacent to the opening; and the left side cover, the right side cover, the top cover, and the at least one bottom cover being laterally connected to the at least one lip.

17. The ethanol fireplace insert as claimed in claim 11 further comprises:

an opening;

at least one fireplace shield;

the opening being delineated by the arch and the base platform; and the at least one fireplace shield being connected to an at least one lip across the opening.

18. The ethanol fireplace insert as claimed in claim 11 further comprises:

the plurality of insulation panels comprises a left side insulation panel, a right side insulation panel, and a top insulation panel;

the plurality of covers comprises a left side cover, a right side cover, a top cover, and an at least one bottom cover;

the rear insulation panel being perpendicularly connected to the top insulation panel, the left side insulation panel, and the right side insulation panel; and the rear cover being perpendicularly connected to the top cover, the left side cover, and the right side cover.

* * * * *